US006293082B1

(12) United States Patent
Stahlecker

(10) Patent No.: US 6,293,082 B1
(45) Date of Patent: Sep. 25, 2001

(54) TRASH REMOVAL METHOD AND APPARATUS FOR AN OPEN END SPINNING MACHINE

(75) Inventor: Fritz Stahlecker, Josef-Neidhart-Strasse 18, 73337 Bad Überkingen (DE)

(73) Assignees: Fritz Stahlecker, Bad Überkingen; Hans Stahlecker, Süssen, both of (DE)

( * ) Notice: Subject to any disclaimer, the term of this patent is extended or adjusted under 35 U.S.C. 154(b) by 0 days.

(21) Appl. No.: 09/524,758

(22) Filed: Mar. 13, 2000

(30) Foreign Application Priority Data

Mar. 12, 1999 (DE) ..... 199 10 940

(51) Int. Cl.[7] ..... D01H 4/36; D01H 11/00

(52) U.S. Cl. ..... 57/301

(58) Field of Search ..... 57/301

(56) References Cited

U.S. PATENT DOCUMENTS

| | | | | |
|---|---|---|---|---|
| 4,183,201 | * | 1/1980 | Stahlecker | 57/301 |
| 4,483,135 | * | 11/1984 | Kurushima et al. | 57/301 |
| 5,647,196 | * | 7/1997 | Wassenhoven | 57/301 |
| 5,943,853 | | 8/1999 | Stahlecker | 57/301 |
| 5,946,899 | * | 9/1999 | Wassenhoven | 57/301 |

* cited by examiner

*Primary Examiner*—Andy Falik
(74) *Attorney, Agent, or Firm*—Crowell & Moring LLP

(57) ABSTRACT

The spinning aggregates, arranged in a row, of an open-end spinning machine are each provided with an opening device, which comprises a removal opening for trash particles. A channel extending in a longitudinal machine direction takes up the expelled trash particles. A sliding carriage traverses to and from in the channel and pushes the trash particles collected in the channel to a suction point. The sliding carriage comprises a cleaning element, which can be pressed to the side wall of the channel under the action of a transverse force.

29 Claims, 7 Drawing Sheets

TRASH REMOVAL METHOD AND APPARATUS FOR AN OPEN END SPINNING MACHINE

BACKGROUND AND SUMMARY OF THE INVENTION

This application claims the priority of German Patent Document 199 10 940.0, filed Mar. 12, 1999, the disclosure of which is expressly incorporated by reference herein.

The present invention relates to an open-end spinning machine comprising a plurality of adjacently arranged spinning aggregates, each of which comprises an opening device having a trash removal opening, under which a channel for taking up expelled trash particles extends in machine longitudinal direction, in which channel a sliding carriage traverses to and from pushing the collected trash particles in front of it to a suction point, said channel comprising a side wall which is disposed in an area of dispersion of the expelled trash particles, against said side wall a lateral cleaning element of the sliding carriage is disposed.

A sliding carriage of this type of a known open-end spinning machine (U.S. Pat. No. 5,943,853) comprises a base body, which is provided at its bottom and at the side walls with brushes. A cleaning element of this type may be sufficient for loose, non-adhering trash particles located in the channel. However, the cleaning element no longer fulfills its function when the trash particles comprise sticky components, for example, honey dew, which adheres to the bottom and to the side wall of the channel, the side wall lying within the dispersion area. Honey dew on the bottom of the channel is not so critical, as here the weight of the sliding carriage affords a sufficient scraping effect most of the time. However, in the case of honey dew on the critical side wall, the brushes, which move past with more, or less, clearance, do not remove sufficient quantities of honey dew.

It is an object of the present invention to improve the known open-end spinning machine so that the cleaning element of the traversing sliding carriage is capable of cleaning the critical side wall of the channel of stubborn adhering trash particles.

This object has been achieved in accordance with the present invention in that the cleaning element is pressed by means of a transverse force to the critical side wall of the channel.

In contrast to the above mentioned prior art, the cleaning element no longer just slides through the clearance at the side wall, but rather is pressed to the critical side wall by means of a sufficiently strong transverse force. This transverse force can be stronger or weaker, according to what is required.

The embodiments of the present invention can vary. In one embodiment of the present invention, the cleaning element is affixed to the sliding carriage and the entire sliding carriage is then pressed to the side wall. In another embodiment of the present invention, the cleaning element is slidingly supported on the sliding carriage and can be moved towards the side wall. In the former case, the transverse force must act on the entire mass of the sliding carriage, whereby in the latter case the transverse force need only act on the significantly smaller cleaning element.

The cleaning element is preferably provided with friction grooves or the like, which are arranged in a friction wall which can be disposed on the side wall. A friction wall of this type is more suitable for greater forces than, for example, the bristles of a brush in prior art. In addition there is the fact that a friction wall is in turn easier to clean than a plurality of individual bristles.

For the purpose of the present invention, the sliding carriage comprises a sliding surface guided on the side wall, in which sliding surface the cleaning element is arranged so that it can be countersunk. The entire sliding carriage can thus, as in the case of the known open-end spinning machine, be guided with clearance slidingly between the side walls of the channel, while only the cleaning element is loaded with a transverse force.

The transverse force can be activated in a variety of ways.

In a preferred embodiment of the present invention, the transverse force can be activated due to the traversing movement of the sliding carriage, for example, in that the cleaning element comprises at least one wedge-like guiding surface, on which, due to the traverse motion, a corresponding counter surface is disposed. The wedge-like guiding surface is disposed diagonally to the direction of motion of the sliding carriage, so that a longitudinal force applied to the cleaning element holds a component towards the side wall. In an embodiment of the present invention the cleaning element can hereby—according to the two traverse directions—comprise two guiding surfaces, which form an angle of approximately 90°.

In a further embodiment of the present invention, the transverse force can be generated by means of at least one spring. This has the advantage that any chosen degree of transverse force can be applied and that either only the cleaning element or the entire sliding carriage can be pressed to the side wall as required. It can hereby be provided that the cleaning element takes the form of the sliding surface which guides the sliding carriage to the side wall.

Other objects, advantages and novel features of the present invention will become apparent from the following detailed description of the invention when considered in conjunction with the accompanying drawings.

DETAILED DESCRIPTION OF THE DRAWINGS

Figure 1:
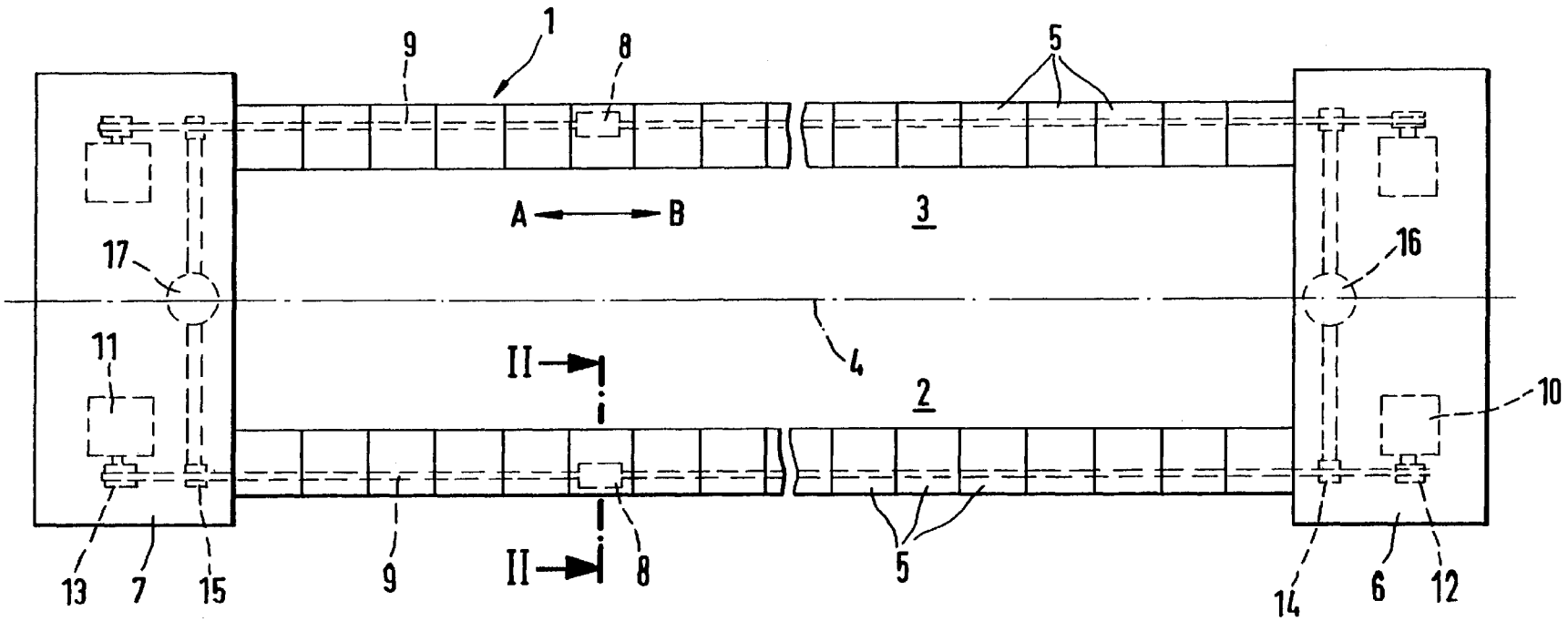
FIG. 1 is a top view of a schematically shown open-end spinning machine having a traversing sliding carriage on each machine side, constructed according to a preferred embodiment of the present invention.

The open-end spinning machine 1 as shown in FIG. 1 comprises two machine sides 2 and 3, which are arranged symmetrically to a central longitudinal plane 4. On each machine side 2, 3 a plurality of identical spinning aggregates 5 are arranged in a row adjacently to one another. These spinning aggregates 5 comprise feed, opening and twist devices in a known way, which are represented only very schematically by a rectangle in FIG. 1.

At each end face side, the open-end spinning machine 1 comprises a headstock 6 and 7, in which in a known way the drives and other supply aggregates are housed.

As described below in more detail in reference to the following Figures, a sliding carriage 8 is arranged on each machine side 2,3 below the individual spinning aggregates 5. Each of these two sliding carriages 8 can be moved by means of a traction belt 9 according to the traverse directions A and B in machine longitudinal direction.

Two drive motors 10 and 11 serve the traverse motion of the two sliding carriages 8, to which drive motors 10 and 11 wind-up discs 12 and 13 for the traction belt 9 in the form of a thin steel belt are arranged. The traction belt 9 is temporarily wound alternately onto these wind-up discs 12 and 13 during the traverse motion. As soon as the sliding carriage 8 has reached the respective headstock 6 or 7, the drive motors 10 and 11 change their rotational direction by means of control devices (not shown).

Both sliding carriages 8 serve to transport trash particles away in a way described in more detail below, which trash particles are expelled downwards at the individual spinning aggregates 5.

The sliding carriages 8 push the trash particles along in a channel which is described in more detail below, namely to a suction point 14,15 in the respective headstocks 6 and 7. At these suction points 14,15, the trash particles are removed pneumatically from the channel. The respective traction belt 9 can hereby also be cleaned. Vacuum sources 16 and 17, for example, vacuum pumps, arranged in the headstocks 6 and 7, serve to create a vacuum.

Figure 2:
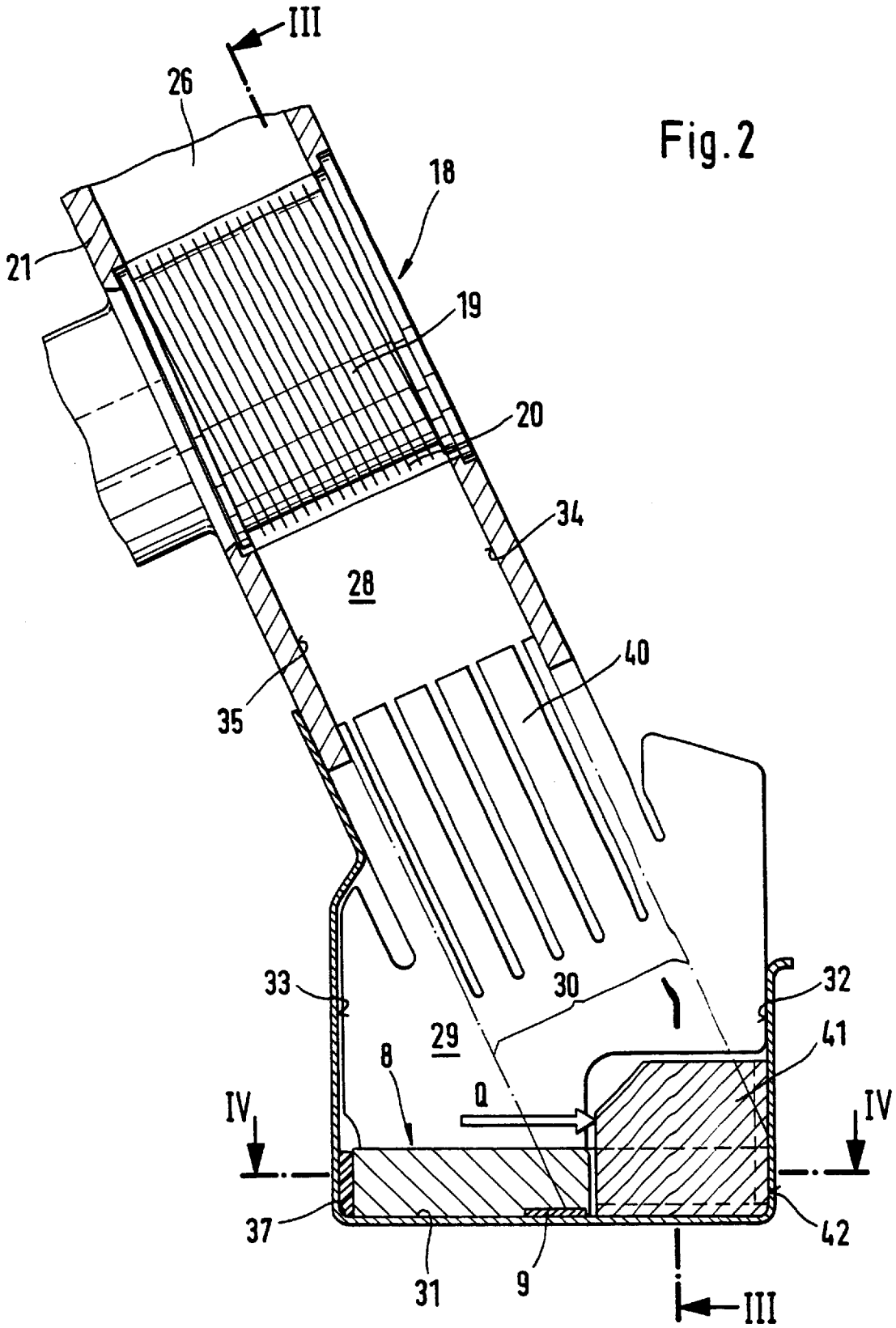
FIG. 2 is in enlarged dimensions a sectional view through an opening device of a spinning station, taken along the section plane II—II of FIG. 1.
Figure 3:
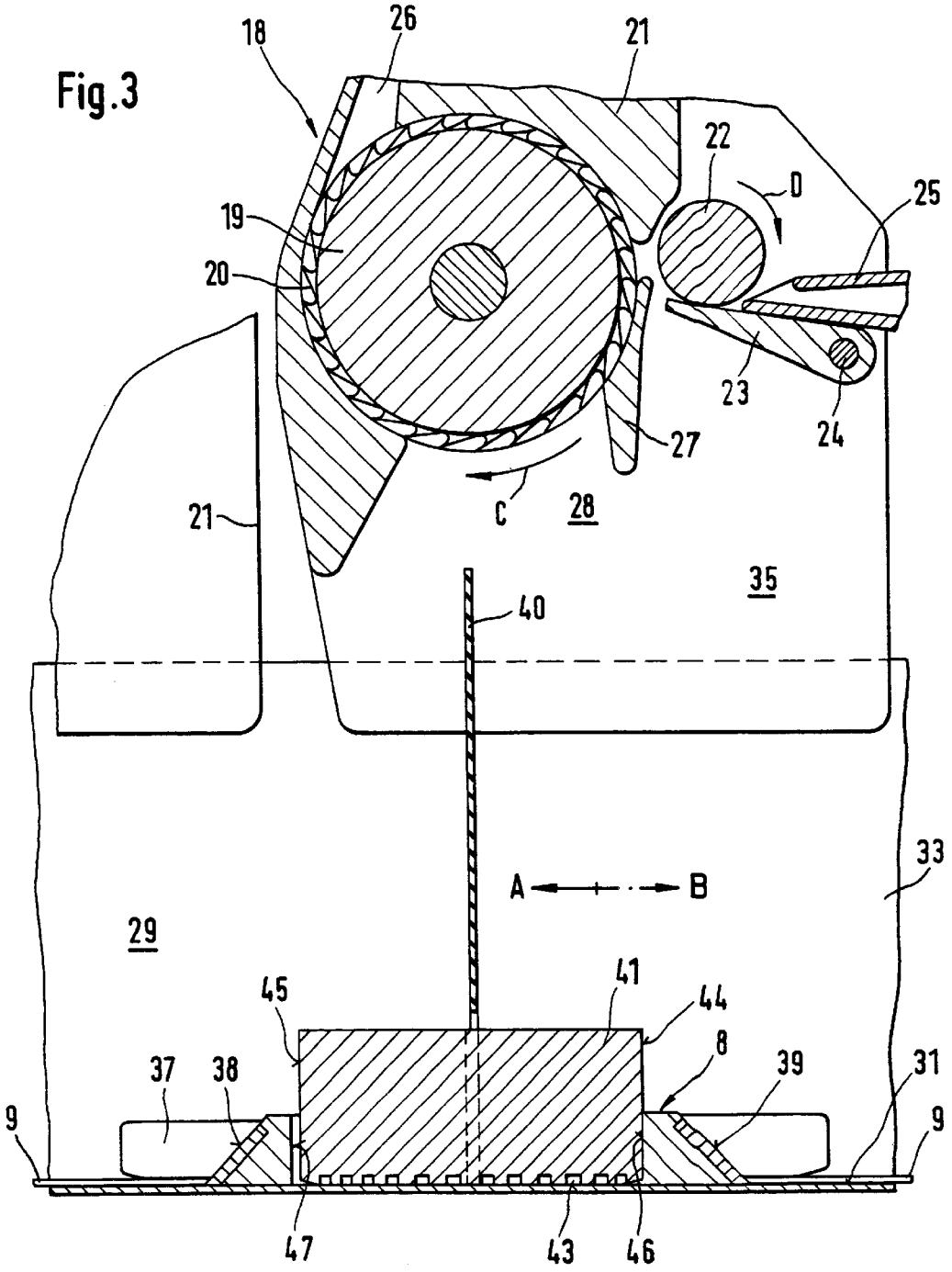
FIG. 3 is a sectional view along the sectional plane III—III of FIG. 2.
Figure 4:
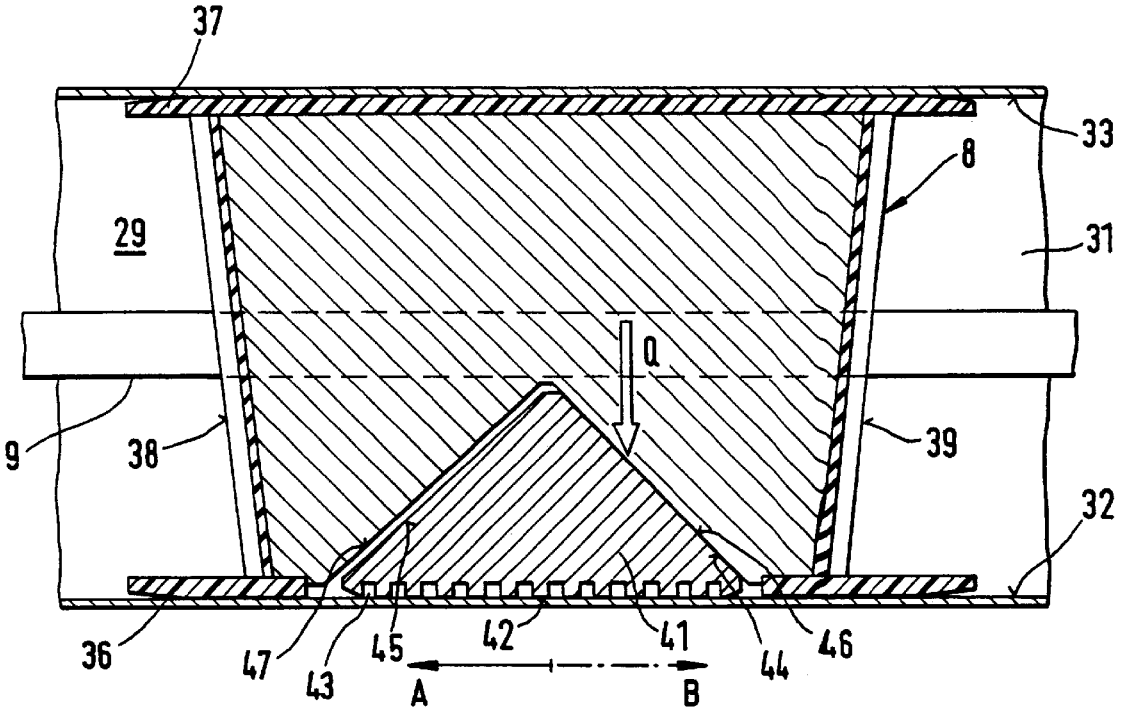
FIG. 4 is sectional view along the sectional plane IV—IV of FIG. 2.

As can be seen more clearly from the three different views of the FIGS. 2, 3 and 4, the spinning aggregates 5 each comprise an opening device 18 having an opening roller 19 rotating in direction C. These are provided in a known way with a combing structure 20, which serves to comb individual fibers out of the fed sliver, which are then fed to a twist device for spinning in a way not shown. The opening roller 19 rotates in an opening roller housing 21, which comprises, among other components, guiding surfaces surrounding the periphery of the opening roller 19.

A feed roller 22 rotating in rotational direction D is arranged upstream of the opening roller 19. The feed roller functions together with a feed table 23, which presses the fed sliver by means of a loading spring (not shown) to the feed roller 22. The feed table 23 can be swiveled around a swivel axle 24. A feed condenser 25 for the fed sliver is arranged in turn upstream of the feed roller 22.

The end of the fed sliver is nipped at the nipping point between feed roller 22 and feed table 23, whereby the fiber beard which arises as a result is constantly combed by the opening roller 19 to single fibers. These are transported along the periphery of the opening roller 19 to a fiber feed channel 26, from where they reach a spinning rotor (not shown) which is in a vacuum. The combing of the fiber beard is supported by a stationary fiber beard support 27.

While the combed single fibers follow the periphery of the opening roller 19, heavier trash particles are removed from the combing structure 20 as a result of the centrifugal forces. These trash particles are centrifuged through a removal opening 28 located in the opening roller housing 21 between the fiber beard support 27 and the fiber feed channel 26.

Below the removal opening 28 of the individual spinning aggregates 5 extends in machine longitudinal direction a channel 29, in which the trash particles are collected. The channel 29 is essentially U-shaped in cross section, whereby the opening faces the opening roller 19. The channel 29 extends to the suction points 14 and 15 in the headstocks 6 and 7.

As can be seen in particular in FIG. 2, the trash particles are expelled in a so-called area of dispersion 30, which is denoted by dot-dash border lines. In the present case, the area of dispersion 30 is relatively exactly defined in that the axle of the opening roller 19 extends transversely to the machine longitudinal direction, that is, the effective width of the combing structure 20 extends essentially transversely to the bottom 31 of the channel 29. The guiding surfaces 34 and 35 of the opening roller housing 21 located underneath the opening roller 19 correspond in their distance to one another to the effective width of the opening roller 19 and define practically the area of dispersion 30. It can be seen that the side wall 32 located on the operator's side of the spinning aggregate 5 still lies within the area of dispersion 30, while the other side wall 33 remains practically free of trash particles.

The trash particles collected in the channel 29 are pushed by the traversing sliding carriage 8, as mentioned above, to the suction points 14 and 15. The dead weight of the sliding carriage 8 is calculated to be sufficient for the purpose. Apart from the lateral sliding surfaces 36 and 37, which serve the guiding of the sliding carriage 8 at the side walls 32 and 33 of the channel 29, the width of the sliding carriage 8 covers almost the entire bottom 31 of the channel 29.

On the front and back sides, in the respective direction of motion, the sliding carriage 8 comprises diagonal, shovel-like pushing surfaces 38 and 39, which can each be provided with a wear resistant insert. These pushing surfaces 38 and 39 function like a snow shovel. At the side wall 32, which lies in the area of dispersion 30, and at the other side wall 33, the pushing surfaces 38 and 39 are not directly disposed thereon, as the sliding surfaces 36 and 37, which are to prevent the sliding carriage 8 tilting, are located here. For this reason, the sliding carriage 8 is somewhat narrower at the side wall 32 than at the other side wall 33, so that the pushing surfaces 38 and 39 each extend inclined to the direction of motion. The pushing surfaces 38 and 39 extending inclined to the channel 29 enable a better sliding of the sliding carriage 8 over any possible section seams of the channel 29.

As can be seen from FIGS. 2 and 3, a rubber wiper 40 can be applied to the sliding carriage 8, which serves to clean the guiding surfaces 34 and 35 of the opening roller housing 21 during traverse motion.

The trash particles, expelled essentially in the dispersion area 30, can, depending on the fiber material to be spun, and in particular in the case of some types of cotton, contain very sticky honey dew. While the honey dew is, as a rule, removed from the bottom 31 of the channel 29 by the dead weight of the sliding carriage 8, the side wall 32 in particular, disposed in the dispersion area 30, is at risk from the honey dew. The other side wall 33 is less problematic.

It is here that the present invention comes into its own with the particular purpose of removing stubborn deposits from the side wall 32 of the channel 29 arranged at the dispersion area 30. It is assumed that according to FIGS. 2, 3 and 4, the momentary direction of motion of the sliding carriage 8 occurs according to the arrow direction A.

The sliding carriage 8 as shown in FIGS. 2 to 4 comprises a cleaning element 41, which could in the present case perhaps be called a "cleaning stone", which is pressed to the side wall 32 by means of specially generated transverse force Q. The cleaning element 41 has a scraping effect during traverse motion and can remove honeydew from the side wall 32. The stone-like cleaning element 41 is supported in the sliding carriage 8 in such a way that it can be displaced transversely, and which is countersinkable in relation to the sliding surfaces 36 and 37. The cleaning element 41 comprises a friction wall 42 which is directed against the side wall 32, which friction wall 42 is overall higher than the sliding carriage 8 and which projects upwards out over the dispersion area 30. The friction wall 42 interrupts the side of the sliding surface 36 facing the side wall 32, while the other sliding surface 37 of the sliding carriage 8 is not interrupted.

The friction wall 42 as well as the bottom of the stone-like cleaning element 41 are provided with friction grooves. These support the scraping effect of the cleaning element 41.

Figure 4A:
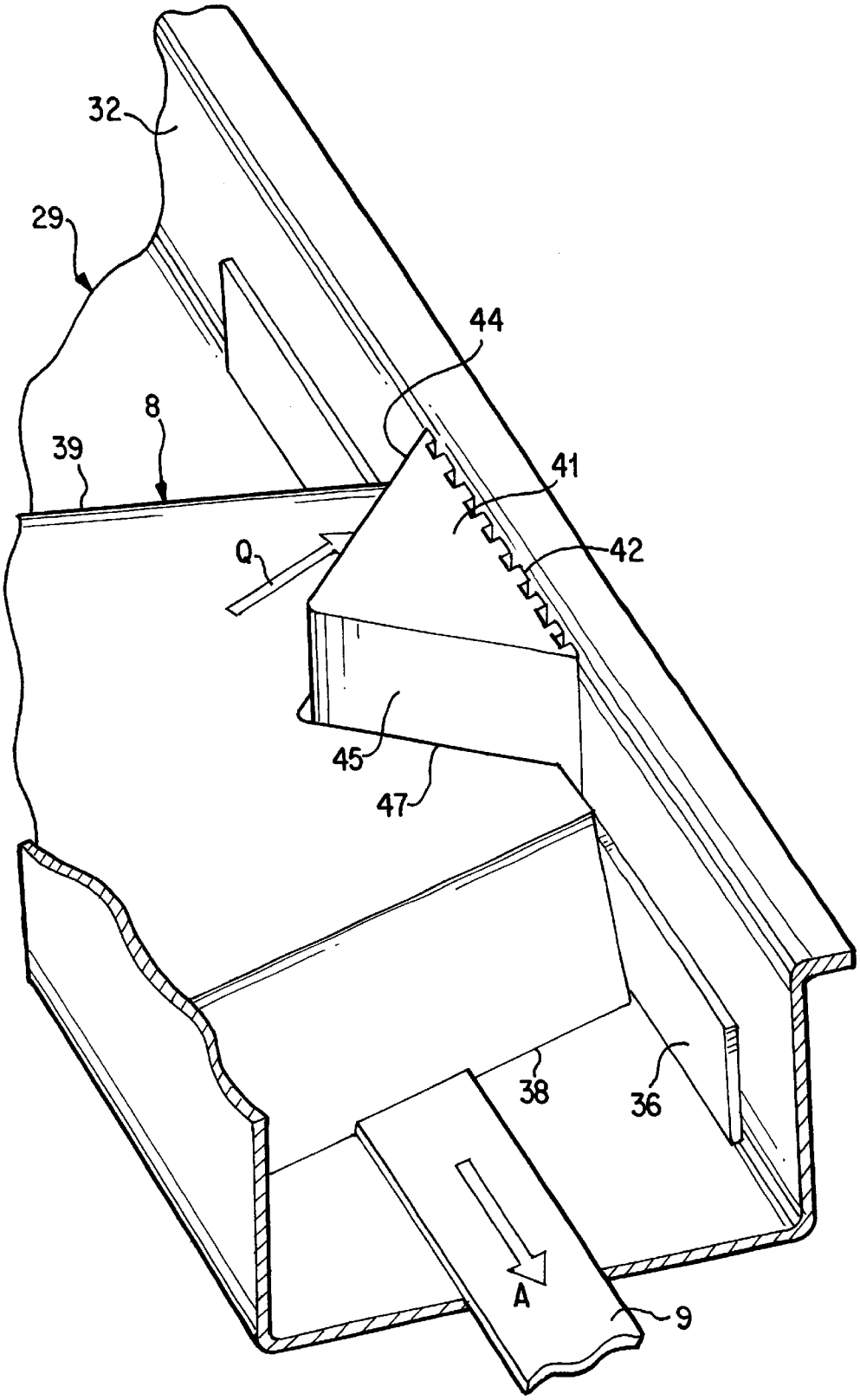
FIG. 4A is a schematic oblique view of the arrangement of FIG. 4.

In the present case, the transverse force Q, which is responsible for the scraping effect, is activated by the traverse motion of the sliding carriage 8. The cleaning element 41 comprises for this purpose, as can be seen in FIGS. 4 and 4A, two wedge-shaped guiding surfaces 44 and 45, which extend diagonally to the direction of motion and which form an angle between them of approximately 90°. Correspondingly formed countersurfaces 46 and 47 of the base body of the sliding carriage 8 are arranged at these guiding surfaces 44 and 45 of the cleaning element 41. The stone-like cleaning element 41 is guided with clearance between the countersurfaces 46 and 47, and the transverse force Q is exerted on the cleaning element 41 during the movement of the sliding carriage 8 in arrow direction A by means of the counter surface 46, so that the cleaning element 41 is disposed against the side wall 32 under the action of the force Q. In the case of the other traverse motion according to the arrow B, the counter surface 47 of the carriage 8 would be disposed on the guiding surface 45 of the stone-like cleaning element 41.

In case the other side wall 33 is also to be cleaned, a corresponding cleaning element could be additionally provided on the other side of the sliding carriage 8.

Figure 5:
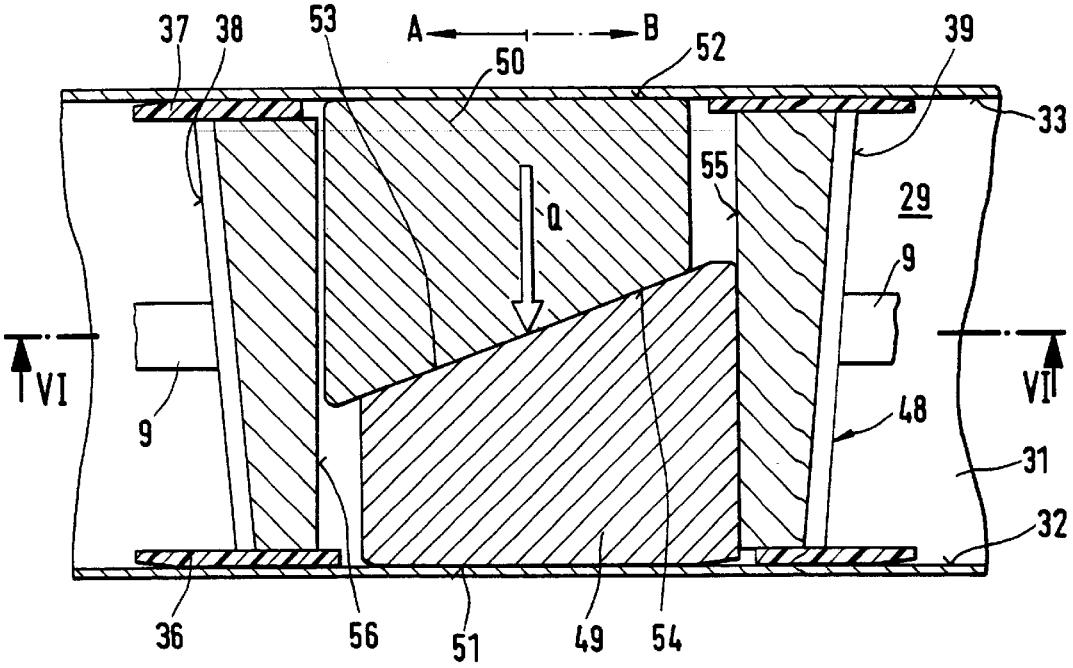
FIG. 5 is a view similar to FIG. 4, showing a further embodiment of the present invention, along the intersectional plane V—V of FIG. 6.
Figure 6:
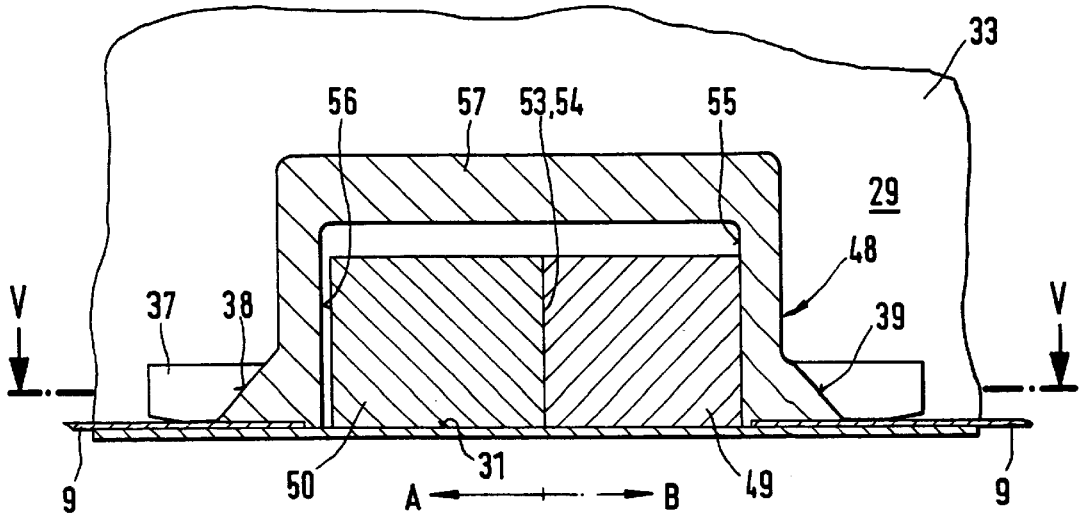
FIG. 6 is a sectional view along the sectional plane VI—VI of FIG. 5.

The description of the embodiment of the present invention according to FIGS. 5 and 6 is based on the premise that the sliding carriage denoted by 48 is moving momentarily in arrow direction A. The channel 29 with the bottom 31, the critical side wall 32 as well as the other side wall 33 can all be seen. The sliding carriage 48 is here also pulled by a traction belt 9 to traverse and guided to the side walls 32 and 33 by means of sliding surfaces 36 and 37. The sliding carriage 48 comprises further here also the diagonal shovel-like pushing surfaces 38 and 39.

In the sliding carriage 48 according to FIGS. 5 and 6, two cleaning elements 49 and 50 are supported easily displaceable to one another. Both cleaning elements 49 and 50 are each again in the form of so-called cleaning stones. The cleaning element 49 comprises a friction wall 51, which is arranged to the side wall 32, while the cleaning element 50 comprises a friction wall 52, which belongs to the other side wall 33.

The cleaning elements 49 and 50 comprise each a wedge-shaped guiding surface 53 or 54. These do not function with corresponding countersurfaces of the sliding carriage 48, but rather are disposed on top of one another. The guiding surface 53 of the cleaning element 49 is disposed thus on the guiding surface 54 of the cleaning element 50. Both guiding surfaces 53 and 54 extend diagonally in relation to the motion of direction of the sliding carriage 48.

The sliding carriage 48, bridging the cleaning elements 49 and 50 by means of a crossbar 57 extending in machine longitudinal direction, comprises two pushing surfaces 55 and 56, between which the two cleaning elements 49 and 50 are supported in transverse direction with slight clearance. During the movement of the sliding carriage 48 in arrow direction A, the pushing surface 55 is disposed at a corresponding surface of the cleaning element 49, while in the direction of motion according to the arrow B, the other pushing surface 56 would be disposed at a corresponding counter surface of the cleaning element 48. During the movement of the sliding carriage 48, a transverse force Q is generated by the guiding surfaces 53 and 54 being disposed against one another, which force Q presses the one cleaning element 49 against the side wall 32 and—as a counterforce—presses the other cleaning element 50 against the side wall 33.

In the present case, both side walls 32 and 33 are cleaned of stubborn trash particles.

Figure 7:
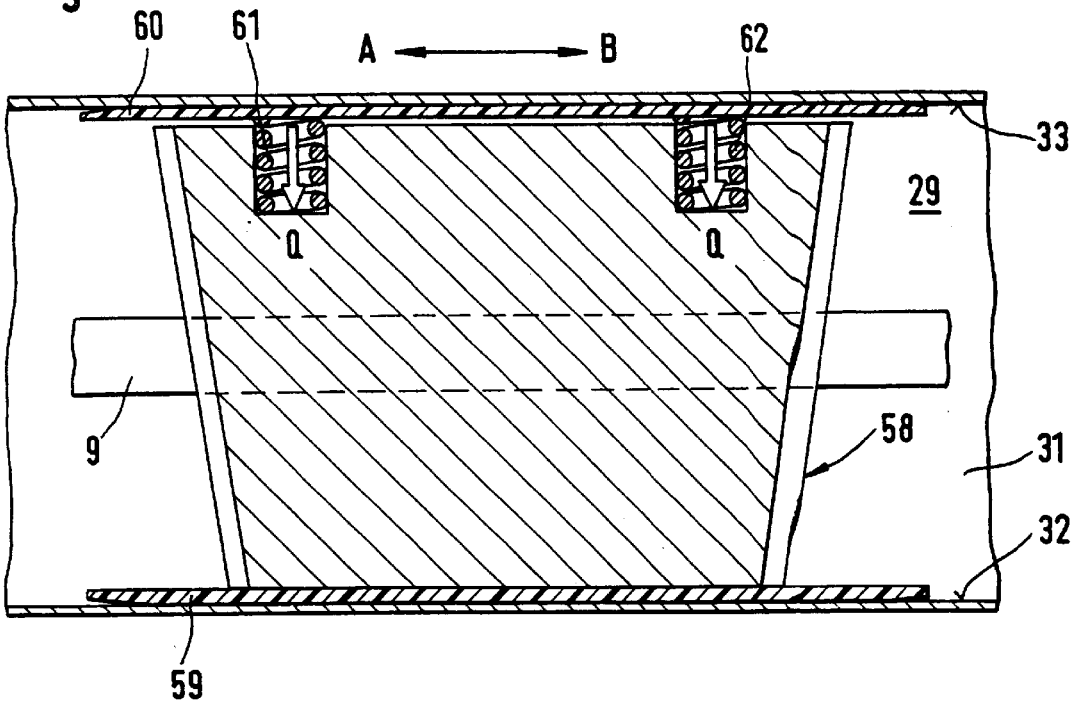
FIG. 7 is a sectional view of a further embodiment of the present invention similar to that shown in FIG. 4.

In the embodiment according to the present invention as shown in FIG. 7, the channel 29, its bottom 31 as well as the two side walls 32 and 33 can be seen again. Here a sliding carriage 58 is provided which comprises on both sides sliding surfaces 59 and 60 facing the side walls 32 and 33, which sliding surfaces 59,60 form here at the same time the cleaning elements. The cleaning element arranged to the critical side wall 32, that is the sliding surface 59, is affixed to the sliding carriage 58, while the other sliding surface 60 is movable transversely to the actual sliding carriage 58 itself.

Between the sliding surface 60 and the actual base body of the sliding carriage 58, pressure springs 61 and 62 are provided, which generate a transverse force Q on the entire sliding carriage 58. The sliding carriage 58 is pressed with its sliding surface 59, which here forms the cleaning element, against the critical side wall 32. It is self-evident that in this case it is is provided that the sliding surface 59 is higher than the area of dispersion 30.

Figure 8:
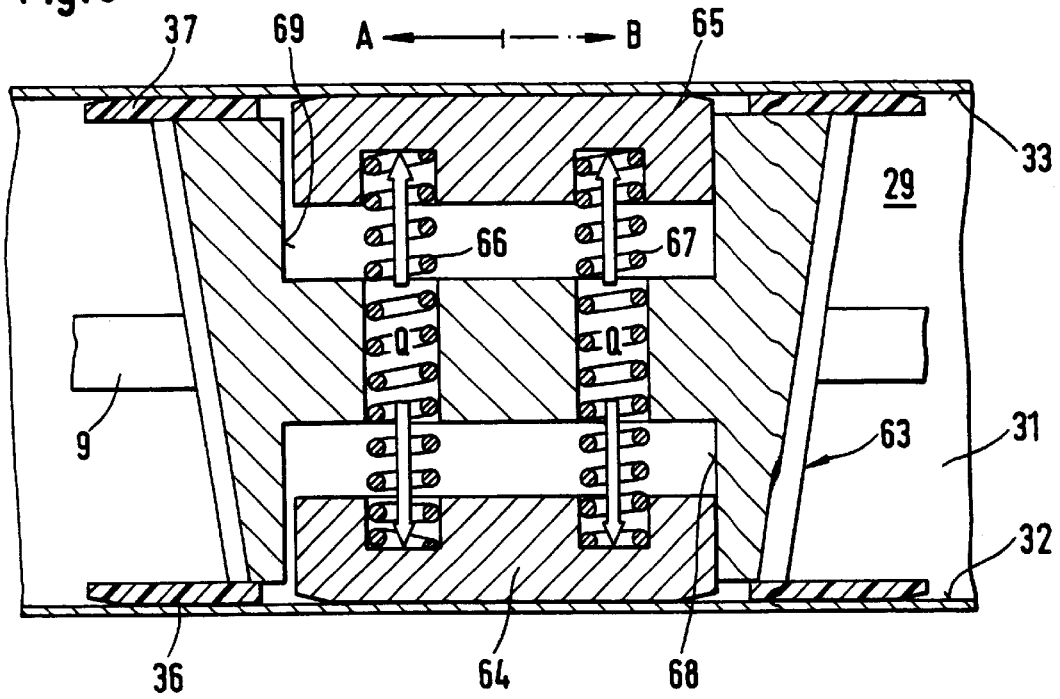
FIG. 8 is a sectional view of a further embodiment of the present invention similar to that shown in FIG. 4.

In the embodiment of the present invention according to FIG. 8, a sliding carriage 63 is provided, which again is pulled by means of a traction belt 9 in a channel 29. The embodiment is based on the premise that the sliding carriage 63 is moving momentarily according to the direction of the arrow A. The sliding carriage 63 is bordered on both sides by sliding surfaces 36 and 37, which are both interrupted to take up cleaning elements 64 and 65.

In the present case, two cleaning elements 64 and 65 are provided, which are supported transversely displaceable in the sliding carriage 63. The are loaded against one another by means of pressure springs 66 and 67, so that both cleaning elements 64 and 65, which again are in the form of cleaning stones, are pressed to the side walls 32 and 33.

The two cleaning elements 64 and 65 are supported in a recess of the sliding carriage 63, namely with some clearance in longitudinal direction. During the movement of the sliding carriage 63 in arrow direction A, a stopper 68 of the sliding carriage 63 is disposed on the cleaning elements 64 and 65, while during the movement according to the arrow direction B, a further stopper 69 would be disposed. By means of these stoppers 68, 69, the cleaning elements 64 and 65 are taken along with the movement of the sliding carriage 63, while the pressure springs 66 and 67 ensure the respective transverse forces Q.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. An open-end spinning machine comprising a plurality of adjacently arranged spinning aggregates, each of which comprises an opening device having a trash removal opening, under which a channel for taking up expelled trash particles extends in a machine longitudinal direction, in which channel a sliding carriage traverses to and from pushing the collected trash particles in front of it to a suction point, said channel comprising a side wall which is disposed in an area of dispersion of the expelled trash particles, a lateral cleaning element of the sliding carriage being disposed against said side wall, wherein the cleaning element is pressed by means for applying a transverse force to the side wall of the channel.

2. An open-end spinning machine according to claim 1, wherein the cleaning element is affixed to the sliding carriage, and wherein the sliding carriage is pressed against the side wall.

3. An open-end spinning machine according to claim 2, wherein the cleaning element comprises a friction wall which can be disposed on the side wall and which is provided with friction grooves.

4. An open-end spinning machine according to claim 3, wherein the means for applying a transverse force is activated by traverse motion of the sliding carriage.

5. An open-end spinning machine according to claim 4, wherein the cleaning element comprises at least one wedge-shaped guiding surface, on which a corresponding countersurface is disposed as a result of the traverse motion.

6. An open-end spinning machine according to claim 4, wherein the cleaning element comprises two guiding surfaces which form an angle to one another of approximately 90°, said guiding surfaces being engageable with respective counter surfaces of a base body of the sliding carriage.

7. An open-end spinning machine according to claim 2, wherein the means for applying a transverse force is activated by traverse motion of the sliding carriage.

8. An open-end spinning machine according to claim 1, wherein the cleaning element is supported in the sliding carriage in a way in which it can be displaced towards the side wall.

9. An open-end spinning machine according to claim 8, wherein the cleaning element comprises a friction wall which can be disposed on the side wall and which is provided with friction grooves.

10. An open-end spinning machine according to claim 8, wherein the sliding carriage comprises a sliding surface guided along the side wall, in which sliding surface the cleaning element is arranged in a countersinkable way.

11. An open-end spinning machine according to claim 8, wherein the means for applying a transverse force is activated by traverse motion of the sliding carriage.

12. An open-end spinning machine according to claim 11, wherein the cleaning element comprises at least one wedge-shaped guiding surface, on which a corresponding countersurface is disposed as a result of the traverse motion.

13. An open-end spinning machine according to claim 8, wherein the means for applying a transverse force includes at least one spring.

14. An open-end spinning machine according to claim 1, wherein the cleaning element comprises a friction wall which can be disposed on the side wall and which is provided with friction grooves.

15. An open-end spinning machine according to claim 14, wherein the sliding carriage comprises a sliding surface guided along the side wall, in which sliding surface the cleaning element is arranged in a countersinkable way.

16. An open-end spinning machine according to claim 14, wherein the means for applying a transverse force is activated by traverse motion of the sliding carriage.

17. An open-end spinning machine according to claim 16, wherein the cleaning element comprises at least one wedge-shaped guiding surface, on which a corresponding countersurface is disposed as a result of the traverse motion.

18. An open-end spinning machine according to claim 1, wherein the sliding carriage comprises a sliding surface guided along the side wall, in which sliding surface the cleaning element is arranged in a countersinkable way.

19. An open-end spinning machine according to claim 18, wherein the means for applying a transverse force is activated by traverse motion of the sliding carriage.

20. An open-end spinning machine according to claim 19, wherein the cleaning element comprises at least one wedge-shaped guiding surface, on which a corresponding countersurface is disposed as a result of the traverse motion.

21. An open-end spinning machine according to claim 18, wherein the means for applying a transverse force includes at least one spring.

22. An open-end spinning machine according to claim 1, wherein the means for applying a transverse force includes at least one spring.

23. An open-end spinning machine according to claim 22, wherein the cleaning element is at the same time a sliding surface which guides the sliding carriage to the side wall.

24. An open end spinning machine cleaning assembly operable to clean trash from a channel extending adjacent a plurality of spinning stations arranged side by side, said cleaning assembly comprising:

a sliding carriage disposable in the channel and operable to push trash to a respective channel trash removal opening, a lateral cleaning element carried by the sliding carriage and operable to clean at least one lateral wall of said channel, and force applying means for applying lateral force to force the cleaning element against a lateral wall of said channel to clean the same.

25. A cleaning assembly according to claim 24, wherein the force applying means includes interengageable inclined surfaces of the carriage and cleaning element.

26. A cleaning assembly according to claim 24, wherein the force applying means includes spring means interposed between the carriage and cleaning element.

27. A method of cleaning trash from a channel extending adjacent a plurality of spinning stations arranged side by side in an open end spinning machine, said method comprising:

moving a sliding carriage in the channel to push trash to a respective channel trash removal opening, carrying a lateral cleaning element with the sliding carriage which is operable to clean at least one lateral wall of said channel, and applying lateral force to force the cleaning element against a lateral wall of said channel to clean the same.

28. A method of cleaning trash according to claim 27, wherein the step of applying lateral force includes moving interengageable inclined surfaces of the carriage and cleaning element with respect to one another.

29. A method of cleaning trash according to claim 27, wherein the step of applying lateral force includes applying spring force by spring means interposed between the carriage and cleaning element.

* * * * *